US005622075A

United States Patent [19]

Deutschewitz et al.

[11] Patent Number: 5,622,075

[45] Date of Patent: Apr. 22, 1997

[54] BENDING MACHINE

[75] Inventors: Manfred Deutschewitz, Solingen; Manfred Mitze, Wetter, both of Germany

[73] Assignee: MAE Maschinen - und Apparatebau Gotzen GmbH & Co. KG, Germany

[21] Appl. No.: 331,514

[22] PCT Filed: May 4, 1993

[86] PCT No.: PCT/DE93/00404

§ 371 Date: Nov. 1, 1994

§ 102(e) Date: Nov. 1, 1994

[87] PCT Pub. No.: WO93/23184

PCT Pub. Date: Nov. 25, 1993

[30] Foreign Application Priority Data

May 13, 1992 [DE] Germany ..... 42 15 795.1

[51] Int. Cl.[6] ..... B21D 9/08

[52] U.S. Cl. ..... 72/387; 72/389.8; 72/390.3; 72/390.5

[58] Field of Search ..... 72/389.1, 212, 72/389.7, 389.8, 390.3, 390.5, 390.6, 387

[56] References Cited

U.S. PATENT DOCUMENTS

| | | | |
|---|---|---|---|
| 2,276,941 | 3/1942 | Deloghia | 153/48 |
| 3,415,103 | 12/1968 | Crawford et al. | 72/389.1 |
| 4,080,814 | 3/1978 | Eaton | 72/32 |

FOREIGN PATENT DOCUMENTS

| | | |
|---|---|---|
| 630782 | 12/1927 | France . |
| 2606061 | 8/1977 | Germany . |
| 3445544 | 1/1986 | Germany . |
| 1148424 | 6/1989 | Japan . |
| 1368062 | 1/1988 | U.S.S.R. . |
| 1404141 | 6/1988 | U.S.S.R. . |

OTHER PUBLICATIONS

International Search Report, dated Aug. 24, 1993.
International Preliminary Exam Report, W/Annexes, dated Aug. 8, 1994.

*Primary Examiner*—David Jones
*Attorney, Agent, or Firm*—Vickers, Daniels & & Young

[57] ABSTRACT

The bend-straightening machine (100) for workpieces (20) that are more long than wide, such as camshafts, pinion shafts, and similar items, includes one or more straightening dies (14) that bring about on the workpiece (20), between straightening bases that are placed on the machine table (10), a change in the shape of a bend. The straightening die (14) is mounted on a swiveling mechanism (30), which includes a two-armed lever (36) that can swivel around an axle (32') and that protrudes from the axle (32') on both sides. The straightening die (14) is joined with the one arm (36'), while a drive (31) that causes the swiveling of the two-armed lever (36) acts upon the free end (36") of the other arm. (FIG. 1)

20 Claims, 4 Drawing Sheets

BENDING MACHINE

The invention pertains to a bend-straightening machine of the type for work pieces that are longer than they.

BACKGROUND

With the bend-straightening machine, the straightening is carried out in accordance with DE 34 45 544 A1, in which the workpiece, a pinion shaft or a camshaft for example, is deflected between two bases by a straightening die at the point at which an impact is present until a permanent change in shape occurs that is opposed to the impact and neutralizes it. The location of the impact is determined by rotating the workpiece through appropriate measuring devices in the longitudinal and circumferential directions. Either an individual straightening die is displaced in an appropriate fashion along the fixed workpiece in the longitudinal direction, or the workpiece is displaced in the longitudinal direction past a fixed straightening die, or there are several straightening dies present which are distributed over the length of the workpiece and which can be actuated as needed.

Usually, the workpiece is supported in a rotating fashion between center points that act as the workpiece seat. The straightening bases on which the workpiece is lying absorb the forces of the straightening die. In the case of a specific workpiece, a series of which are to be straightened, they remain at fixed locations when viewed in the longitudinal direction of the workpiece.

In general, the straightening die, which is attached to an upper part of the machine, is driven vertically by means of a hydraulic piston/cylinder unit. In the cases mentioned, the upper part of the machine is configured either as an upper crosspiece of a double-column press, or as an upper crosspiece of an open-front press with one C-shaped stanchion. In both cases, with the known bend-straightening machines of this type, it is necessary for a solid upper machine part to extend out over the workpiece to support the operating mechanism, or more specifically, the drive for the straightening die. For its part, this drive has a certain size, since the piston/cylinder unit has to have a specific cross-section because of the forces that arise, and therefore has to have a specific length because of the necessary length of the piston travel. In the case of U.S. Pat. No. 2,276,941, above the C-shaped stanchion a two-armed lever is supported, one arm of which acts upon a vertical spindle that carries the straightening die, and on the other arm of which a drive cylinder located behind the C-shaped stanchion acts.

In a different version, as is known from DE 26 06 061 A1 for example, the entire bend-straightening machine is rotated by 90°, so that the straightening force is exerted horizontally and the straightening bases and the straightening die are moved into a horizontal plane transversely to the longitudinal direction of the workpiece. With this type of bend-straightening machines as well, which usually exhibit a similar machine stanchion in the shape of a "C", the force that is acting upon the straightening die or dies is generated by means of one or more hydraulic piston/cylinder units at a part of the machine that is located to the side, and ahead of the workpiece, and that corresponds to the upper part of the machine in the upright version that was mentioned earlier.

The document SU-A1-1404 141 contains a hydraulic swiveling two-armed lever in which the straightening die is fastened to the free end of one of the arms and moves in the arc of a circle during straightening.

All known bend-straightening machines exhibit a considerable size as a result of the upper part of the machine or, ill the case of the horizontal of the horizontal version, the side part that corresponds to the upper part of the machine. The construction effort that is needed for the frame and the stand is increased even further as a result of the piston/cylinder units that form the single, straight-line hydraulic drive for the straightening die.

SUMMARY OF THE INVENTION

The invention performs the task of designing a bend-straightening machine, in such a way that size, structural expenditures, and power consumption during operation are all reduced.

In accordance with that, the straightening die or dies are actuated by means of a swiveling mechanism. Thus, the propulsion of the straightening die is no longer carried out by means of a linear drive that acts from outside directly against the workpiece and that requires a corresponding amount of space, but is instead carried out by means of a swiveling arrangement that permits a displacement of the drive mechanism from a position that is radial to the workpiece, and so allows a much more compact style of construction. By the swiveling drive, what is meant is the drive during the-straightening stroke, that is, during the exertion of force, and not the displacements of the straightening dies that might have to be responded to in the form of a swiveling movement in order to bring them into the straightening position, nor the possible corresponding workpiece displacements workpiece before the straightening procedure takes place. The structural expenditure for the protruding machine or side parts and for the carriage on which the straightening dies are mounted and guided, and which, as a result of forces that often occur off-center, has to be made especially secure against tilting and therefore correspondingly large, is significantly larger than the structural expenditure for the swivel drive of the straightening die.

Even the first straightening machines that were structurally executed in accordance with the invention have demonstrated that the design volume can be reduced by as much as 40 percent by means of the invention, with the same performance.

The swiveling mechanism is arranged in such a way that the straightening dies exert a force at the location of the workpiece that is, as before, essentially perpendicular to the workpiece and opposite to the straightening bases. What is particularly advantageous about the bend-straightening machine in accordance with the present invention is the fact that the swiveling drive can be implemented underneath the drag bearing of the two-armed lever, or more specifically, under the machine table below the height of the working procedure. As a result of this, the design heights above the workpiece can be kept small and accessibility for the automatic feed devices can be improved, and the swiveling drive remains within the contours of the straightening machine, that is, the drive does not protrude from the top and/or back as is the case with the state of the art.

The straightening dies move in the arc of a circle during the swiveling. The error in the directing of the straightening force that is linked with that is, however, unimportant, since with the workpieces that are to be processed, a straightening stroke of a maximum of 20 mm is sufficient, and the swivel arrangement can be laid out and dimensioned in such a way that the straightening die in the region of the straightening stroke is displaced only slightly to the side relative to the center of the workpiece. This excursion amounts to less than 5°/oo of the straightening stroke, and thus has no effect on the straightening stroke.

Sometimes, such as when straightening bends in workpieces that have a large cross-section and strong deflection, for example, in the case of rolled steel sections for girders and rails, a massive machine upper part with a hydraulic piston/cylinder unit as drive mechanism cannot be avoided. In many cases, however, smaller workpieces that are less resistant to bending are involved, such as pinion shafts, camshafts or driveshafts, for example, which are common in large numbers in the automobile industry, or profile sections of small cross-sections, particularly those made of aluminum, with which there are no large cross-sections and long straightening die strokes are not necessary. It is for goods needing straightening such as these that the invention is primarily intended.

In addition, in a preferred embodiment the swiveling axis of the drag bearing for the two-armed lever is placed parallel to the longitudinal axis of the workpiece, even though forms of implementation that are cross-wise to the longitudinal axis of the workpiece are not excluded in principle.

The implementation permits a manner of construction in which only the straightening die and its carrier arrangement are located above the workpiece.

Other developments of the two-armed lever, in which the forces of the drive mechanism act, include acting cross-wise to the direction of one arm, in one instance and in the same direction as the arm in another instance.

The swiveling constructional unit can act upon one individual straightening die, which is joined with it. Usually, however, there are several straightening dies distributed or placed movably along the workpiece, so that the arrangement of the straightening dies exhibits a certain extension along the workpiece.

For that purpose, each straightening die is no longer assigned its own swiveling mechanism.

The arrangement of the straightening dies is also a feature of the invention.

The drive is implemented, in one possible form of implementation, as a linear drive.

In another embodiment, the drive can act immediately upon the other, free end of the two-armed lever, and a transmission with varying velocity ratio can also be placed in between.

Embodiment of the drive mechanism includes a rotating cam plate, which offers the advantage that the progression of the drive, and thus the progression of the stroke as well, can be freely selected.

In conjunction with this, it is beneficial if the axis of the cam plate is placed vertically underneath the free end of the other, essentially horizontal, arm of the two-armed lever.

In this way, the drive can be displaced into the lower region of the machine pedestal, and the space near the workpiece remains free of drive parts.

The attaining of sufficient clearance between the two-armed lever and the cam plate also serves for the provision of a force transfer link.

The invention can also be put into practice in any desired combinations of the features contained in the claims, while making use of features mentioned in the description as well.

Implementation examples of the invention are represented in the drawings, which illustrate various embodiments that the invention may take in physical form and in certain parts and arrangement of parts wherein:

PREFERRED EMBODIMENTS

Figure 1:
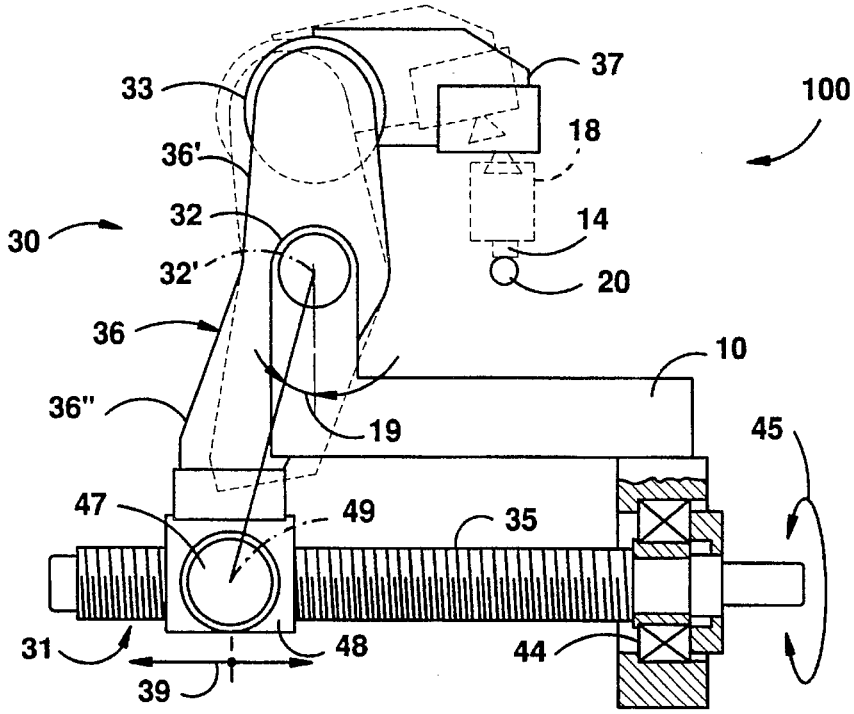
FIG. 1 shows a representation of the essential parts of a first form of implementation of the bend-straightening machine.

In FIG. 1, the workpiece 20 is shown schematically as a cylindrical body that is more long than wide, the axis of which runs perpendicular to the plane of the drawing. In practice, the contours of the workpiece 20 can certainly be irregular as well. For example, camshafts, driveshafts for vehicles, pinion shafts, or similar items can be involved.

The workpiece 20 lies upon straightening bases, which are not shown in FIG. 1, which exhibit a distance from each other in the direction of the axis, and which are placed on the fixed machine table 10. Between these straightening bases, the straightening die 14 acts, by means of a swiveling apparatus that is designated in its entirety as 30, upon the workpiece 20 from above, and deflects it to a desired extent downward, opposite an impact that is present and that, by means of turning the workpiece 20, is displaced upward, in order to bring about on the workpiece 20 a permanent, straightening change in shape that neutralizes this impact.

The straightening die 14 is attached to a straightening hammer 18, which is only shown schematically in FIG. 1 by means of a dashed line, and which is in turn fastened, by means of a dovetail, to the underside of a swiveling head 37 that protrudes approximately horizontally over the workpiece 20 from the side. The swiveling head 37 is seated on a coupling link 33, which extends parallel to the workpiece 20 and is configured as a tube, and which is attached at one of its ends to the free end of an arm portion 36' of a lever 36. Arm portion 36' is upright when in the straightening position. Lever 36 has two arm portions, the aforementioned portion 36' and the lower portion 36". Lever 36 is supported in the center in a swiveling manner by a drag bearing 32, the swiveling axis 32' of which extends parallel to the workpiece axis.

Figure 2:
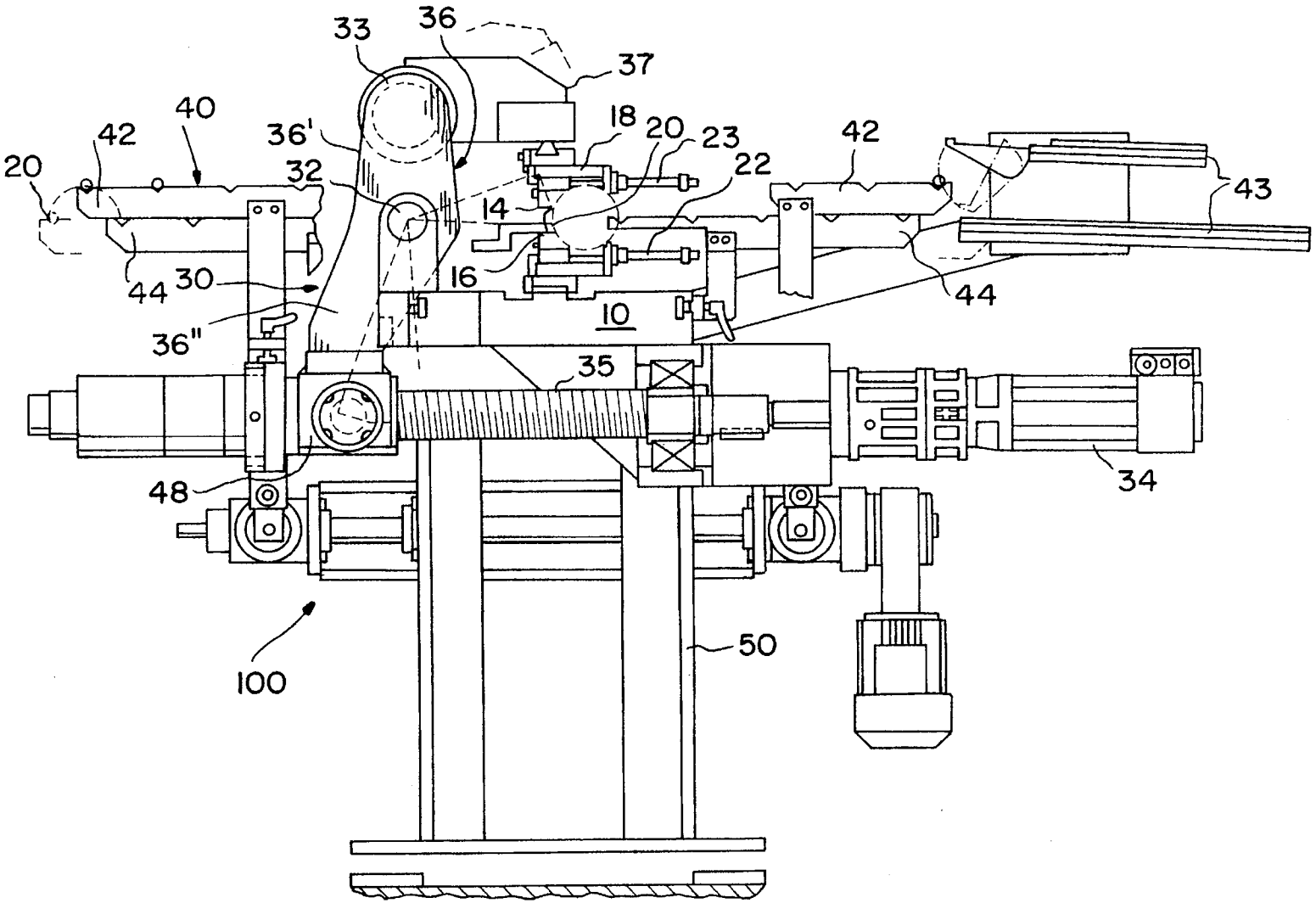
FIG. 2 shows a side view of the complete bend-straightening machine of this form of implementation.

The lever 36, rotates about the drag bearing 32. The other arm portion 36" bends slightly away from the workpiece 20 by a slight angle 19, 18° in the implementation example, relative to the arm 36'. This is done so that it is possible to place the drive spindle 35, which is a part of the swiveling drive 31 of the lever 36, as centrally as possible under the workpiece 20. The drive spindle 35 protrudes from the lever 36 and cross-wise to it, towards the same side as the swiveling head 37 under the machine table 10, and is driven by an electric motor 34 that is shown in FIG. 2, which is indicated by the arrow 45 in FIG. 1.

Figure 3:
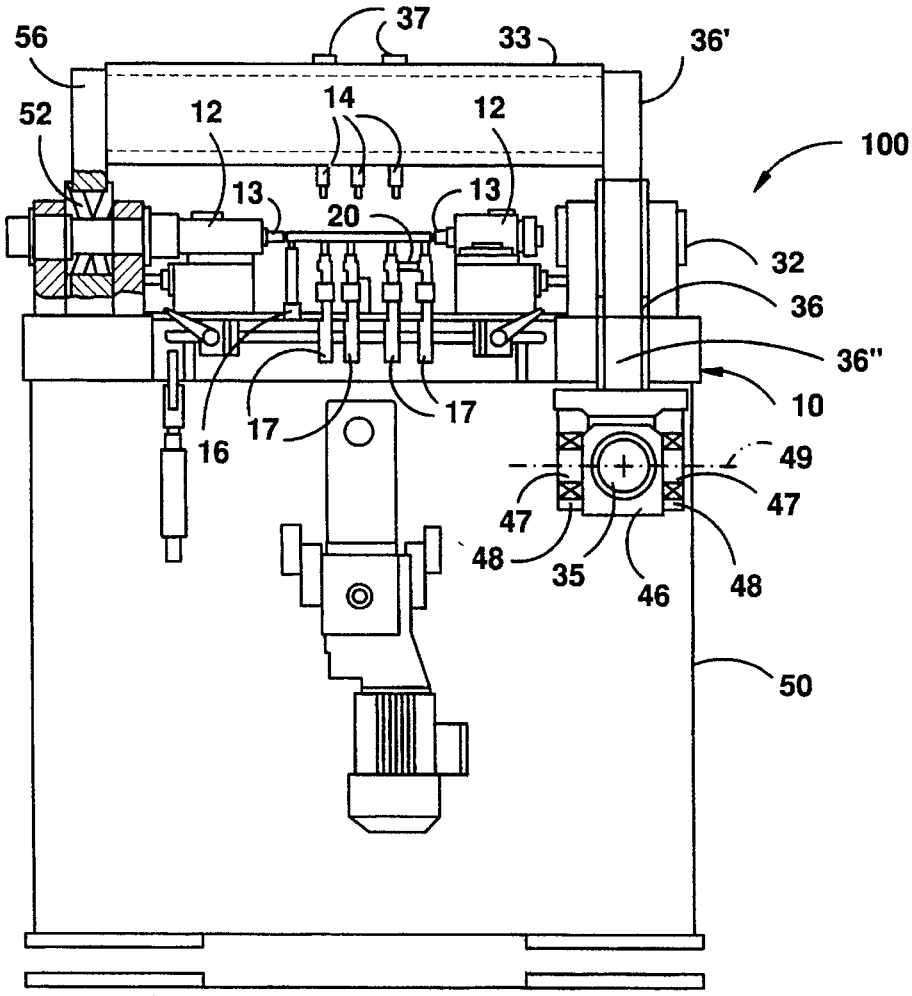
FIG. 3 shows a side view in accordance with FIG. 2, in partial cross-section without the conveyor apparatus for the workpieces.

On the spindle 35 there is placed, in accordance with FIG. 3, a spindle nut 46, which has side bearing journals 47 that are supported in the bearings in the eyes of the fork cheeks 48 that are placed on both sides of the spindle nut 46. The fork cheeks 48 are attached to the lower end of the other arm 36" of the two-armed lever 36.

When the drive spindle 35 turns in the direction of the arrow 45, the spindle nut 46 is displaced in the direction of the arrow 39, and swivels the lever 36, as a result of which the fork cheeks 48 that are joined with it turn around an axle 49 in FIG. 1, which runs perpendicular to the plane of the drawing, with respect to the spindle nut 46. At its right end as shown in FIG. 1, the spindle 35 is supported firmly at the machine in bearings 44, which are capable of dealing with the slight swiveling of the spindle 35 that takes place during the displacement of the spindle nut 46 or the two-armed lever 36. The bearings 44 are either configured as self-aligning bearings, or they have sufficient play around the transverse axis. The stroke that takes place in practice is not particularly large. A limit position of the two-armed lever is shown in FIG. 1 in a dotted line position in which the straightening die 14 has been lifted from the workpiece 20, and the workpiece can be changed. If the straightening die 14 were to be moved downward and work its straightening stroke, the spindle nut 46 would be displaced to the left as a result of the corresponding turning of the spindle 35 in accordance with FIG. 1.

From FIG. 1 it can be seen that the drive 31 of the straightening die does not protrude from the workpiece 20 towards the outside and beyond the ground plan of the machine, but rather, is to a certain extent placed around the workpiece in a space-saving way.

In FIGS. 2 and 3, the bend-straightening machine 100, in which the arrangement in accordance with FIG. 1 is used, is represented in its entirety. It includes a common machine stand 50, and placed on it is the machine stand 10, on which the workpiece seats 12 are built. In the implementation example, the workpiece seats 12 have the shape of center sleeves with center points 13, which engage with corresponding counter-sunk areas in the ends of the rod-like workpiece 20. Several straightening bases 16, which support the workpiece 20 against the force of the straightening die 14 that moves against it from above, are mounted on a positioning rail, and can be displaced, by means of one drive mechanism 22 each (FIG. 2), transversely to the axis of the workpiece 20 as well as in the workpieces longitudinal direction. The straightening dies 14 can likewise be displaced along a positioning rail, by means of drive mechanisms 23, transversely to the workpiece 20 as well as in the workpiece's longitudinal direction. The mounting assembly of the straightening die 14 at the swivelling head 37 forms the so-called straightening hammer 18, to which the straightening die 14 is attached by means of a dovetail guide. In the implementation example (FIG. 3), there are three straightening dies provided, but other numbers can also come into consideration. The radial run-out of the workpiece 20, that is, the "impact", is measured with calipers 17, four of which are present in the implementation example.

During the straightening procedure, the swiveling head 37 with the straightening die 14 is pressed downward against the workpiece 20 by the lever 36. In the implementation example, there are two swiveling heads 37 present (FIG. 3), which exhibit distance between them in the longitudinal direction of the workpiece 20, and which jut out essentially horizontally. They are attached to a connecting link 33, which is configured as a solid tube and which extends along the workpiece 20, and which is joined at one end with the upper end of the one upright arm portion 36' lever 36, and at the other end with the upper end of a lever 56, which matches the arm 36' in size and orientation, and which is supported in a swiveling fashion at the opposite end, in the longitudinal direction of the workpiece 20, of the machine table 10 in a bearing 52 that corresponds to the bearing 32 of the two-armed lever 36.

In this implementation example, the lever 36' is thus provided only on one side, and the one-armed lever 56, which is joined by means of the connecting link 33 and the arm portion 36' to a torsion-resistant constructional unit 30, is simply moved along with it.

It will be appreciated that a second two-armed lever 36 with its own drive mechanism carried out by means of a synchronized rotating spindle 35 could also be provided at the other end. In the same way, in place of the fork cheeks 48, an additional tubular connecting link could be provided, and could engage with a single linear drive at the drive's center.

In the implementation example in the drawing, the drag bearings 32, 52 are mounted with their self-aligning axles exactly at the height of the axis of the workpiece 20 that is to have its bend straightened.

Since, when the straightening die has gone down and is just about to act upon the workpiece 20, the arms 36', 56 are directed approximately vertically upward from the drag bearings 32, 52., and the swiveling head 37 is jutting out approximately horizontally, this results in a geometry in which the effective direction of the straightening die 14 over the course of the straightening stroke under consideration acts nearly exactly vertically downward against the workpiece 20 and the straightening bases 16 that are supporting it. The angular deviation is so slight that it is insignificant in practice.

The Workpieces 20 are conveyed forward and backward by means of a walking beam conveyor 40, which can be seen only in FIG. 2. The walking beams 42, 44 extend through the machine cross-wise to the workpieces 20, and convey the workpieces in increments until they are suspended between the center points 13, and then to the workpiece discharge 43 after the straightening of the bend has taken place. The actuation of the walking beams 42, 44 is carried out by means of stroke mechanisms 41.

Figure 4:
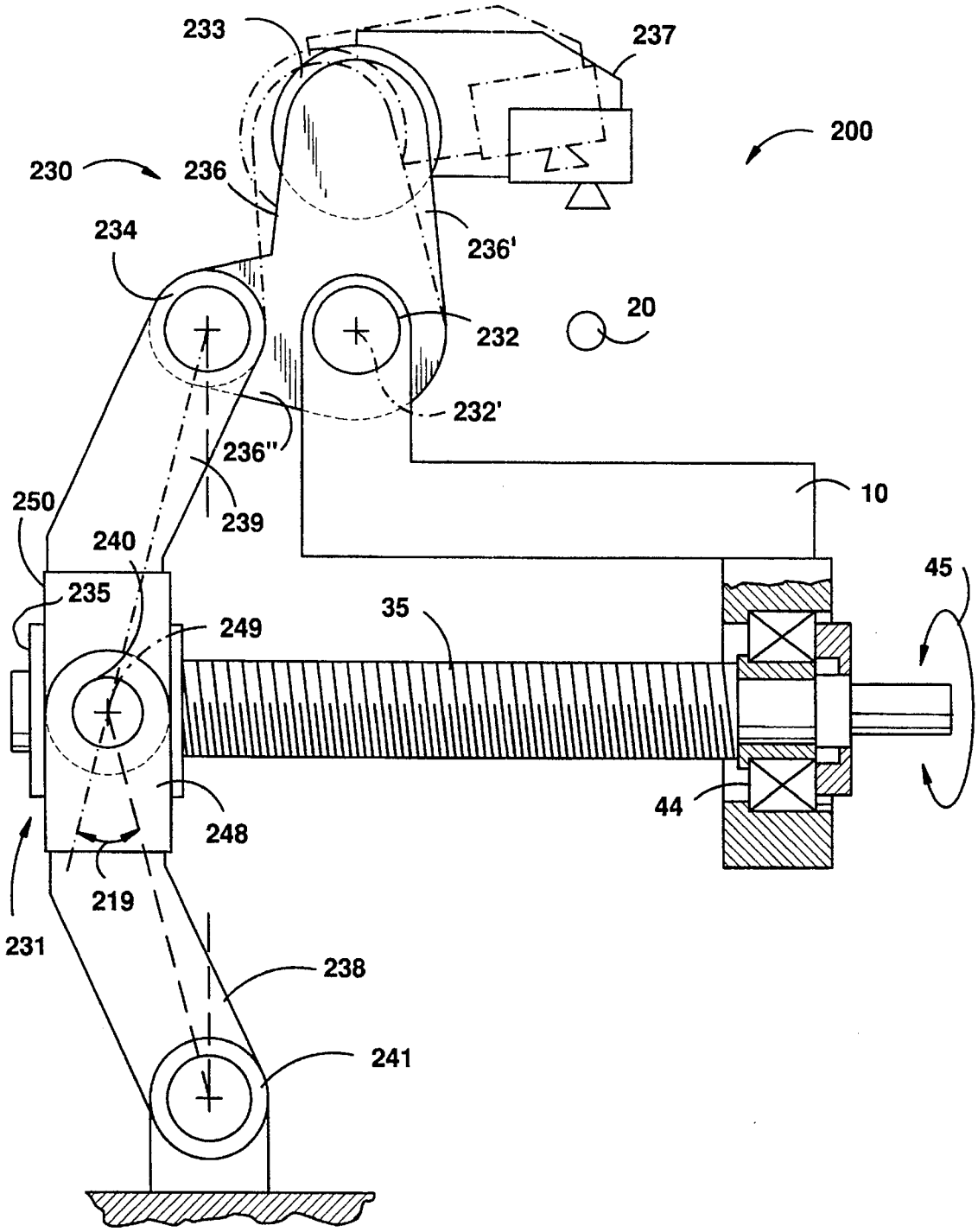
FIG. 4 shows a view, corresponding with that of FIG. 1, of the essential parts of a second form of implementation of the bend-straightening machine.

In an additional implementation example, which is designated in its entirety by 200 in FIG. 4, the swiveling constructional unit 230 is driven by a linear drive 231, which, as in FIG. 1, includes a rotating spindle 35 that is supported at the right end in a bearing 44 in fixed fashion at the machine. Two connecting links 238, 239, which are of approximately the same length in the implementation example, carry fork cheeks 248, 250 on the ends that face each other, overlap the opposing sides of a hinge block 235 that forms the spindle nut, and are supported on bearing journals 240 that protrude from the hinge block 235 in such a way that they can swivel around a common axle 249.

The spindle 35 engages with a spindle screw thread in the hinge block 235, so that the hinge block 235 is, for example and in accordance with FIG. 4, displaced to the right during corresponding rotation of the spindle 35. In conjunction with that, the connecting links 238, 239 swivel around the axle 249.

The lower end of the lower connecting link 238 is supported in a bearing 241 that is fixed to the machine, the upper end of the upper link 239 in a bearing 234 at the free end of the lower, essentially horizontal arm portion 236" of the lever 236. The one arm portion 236' of the lever 236 runs approximately vertically in an upward direction, and carries the swiveling head 237, which, just like in FIG. 1, juts out approximately horizontally over the workpiece 20, and is attached to the tubular connecting link 233.

The lever 236 is supported at its apex in a bearing 232 on the upper side of the machine table 10, and can swivel around its axle 232'.

In the position shown, which roughly corresponds to the beginning of the straightening stroke, the two connecting links 238, 239 form a small angle 219 of approximately 30°with each other, the bisecting line of which is given by the axis of the spindle 35. The connecting links 238, 239 thus form a toggle mechanism that presses the arm 236", which is essentially horizontal and which projects downward from the workpiece 20, upward during a displacement of the hinge block 235 to the right, and thus swivels the lever 236 in the direction of the straightening stroke. The smaller that the angle 219 is, the stronger is the transmission of the force from the spindle 235 that is carried out by means of the toggle mechanism 238, 239. The arrangement is made in such a way that in the shown position of the toggle mechanism 237, 238 and the lever 236, which corresponds to the start of the straightening stroke, there is a smaller angle 219, and when the swivel head is lifted into the position indicated with dotted lines, a displacement of the toggle mechanism 238, 239 into the region of the larger angle 219 takes place, so that a sudden rapid movement takes place and an optimally transferred action by the force is carried out in the actual work area.

Figure 5:
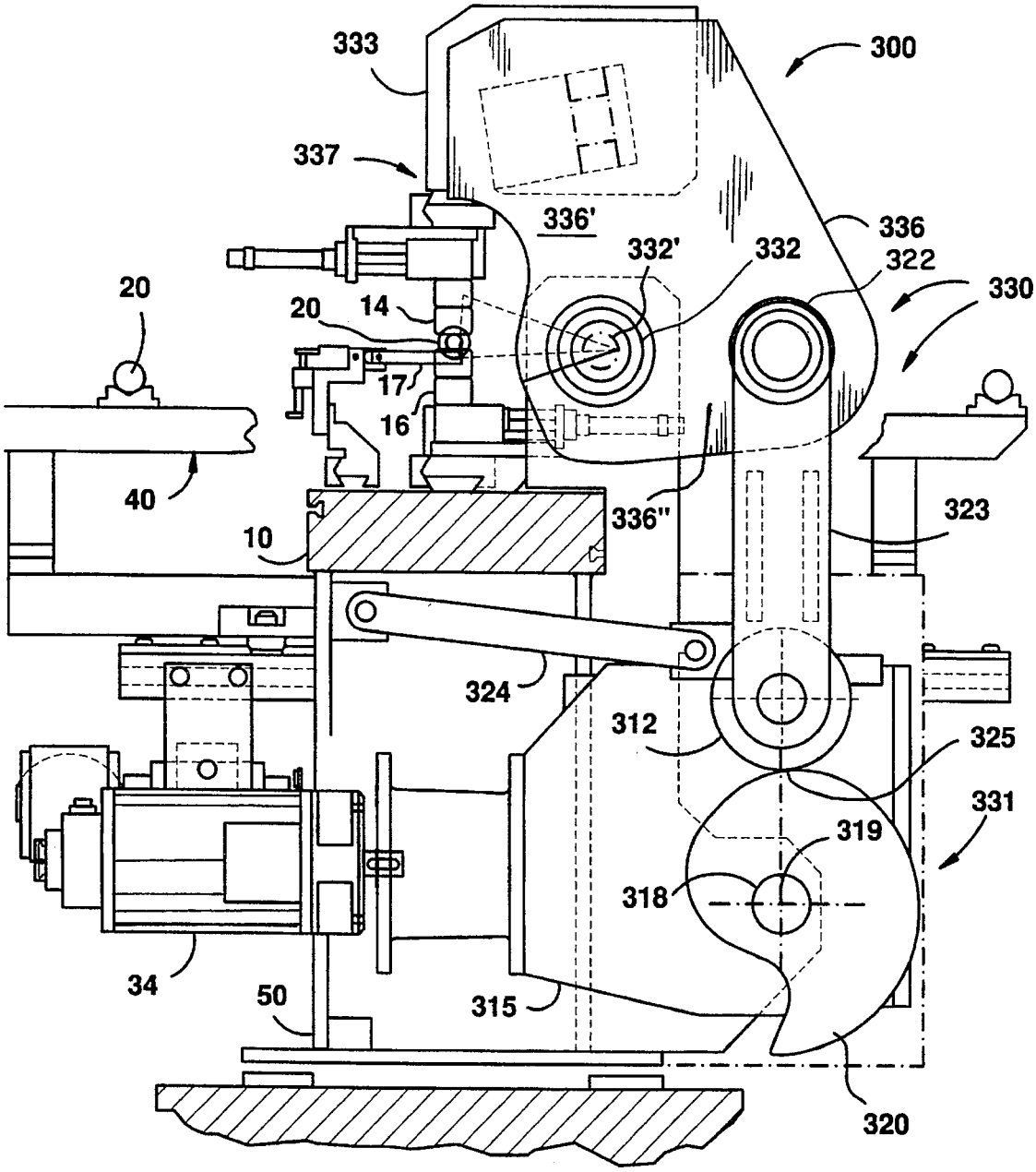
FIG. 5 shows a corresponding view of a third form of implementation.

In FIG. 5, a third form of implementation 300 of the straightening machine is shown, in which there is placed at the machine pedestal 50 and under the machine table 10 a drive motor 34 that acts upon a step-down gear system 315, at which a cam plate 320 can rotate on a shaft 318 around an axle 319 that is perpendicular to the plane of the drawing. At a point 325 that is located vertically above the axle 319, a rotating roller 312 at the lower end of a vertical force transfer link 323 rolls on the cam plate 320. At its upper end, the force transfer link 323 is placed at the right end of the essentially horizontal arm portion 336" of a lever 236 having two arm portions. The lever 336 can swivel on a bearing 332 that is fixed to the machine around an axle 332' that is parallel to the workpiece 20. From the bearing 332, the arm 336' extends in an upward direction and juts out over the workpiece 20 to the left in accordance with FIG. 5, so that to a certain extent, when compared to FIG. 1 the arm 36' there and the swiveling head 37 are formed from one part. The lever 336 is formed by means of a plate, but carries out the function of the previously described lever embodiments as a result of the arrangement of the points of application of force.

The force transfer link 323 and the lever 336 together form the swiveling mechanism 330. The force transfer link 323 is guided in an essentially vertical direction by means of a connecting link 324 that is hinged at the side at its lower end that extends essentially horizontally to a fixing point on the machine pedestal 50, so that the point of contact 325 always remains essentially vertical above the axis of rotation 319 of the cam plate 320.

During rotation by the cam plate 320, the force transfer link 323 is either lifted up or drops down. The shape of the curve of the cam plate 320 can be chosen in such a way that an important multiplication of force is provided within the range of the straightening stroke, and when the straightening die 14 is lifted from the workpiece 20, particularly during the final phase, so that a quick stroke takes place with rapid movement.

As is the case with the form or implementation in accordance with FIG. 2, the workpieces 20 are transported through the straightening machine 300 by means of a walking beam mechanism 40.

The arrangement shown, with cam plate 320, force transfer link 323, and two-armed lever 336, is present at both of the opposite ends, in the longitudinal direction of the workpiece 20, of the machine table 10. The cam plates 320 placed there are linked by the shaft 318. The two levers 336 form a unified, torsion-resistant structural unit 330 by means of the connecting link 333, which likewise extends in the longitudinal direction of the workpiece 20 and which is formed by a box girder.

The straightening machine 300 of FIG. 5 is especially preferable, not only because it reduces the structural expenditure when compared with the usual straightening machines, but also because the energy consumption can be lowered to almost one third as a result of the mechanical actuation by means of the cam plate 320 and the electric motor 334.

Having thus described the invention, it is claimed:

1. Bend-straightening machine for workpieces having longitudinally opposite ends that are more long than wide, said machine including workpiece seats and a machine table, said workpiece seats placed on and above said machine table to hold the ends of the workpiece so it can rotate, at least two straightening bases that are at a distance from each other along the longitudinal direction of the workpiece, said two straightening bases support the workpiece placed on the machine table, at least one straightening die that acts upon the workpiece between the straightening bases, and a lever having two arm portions and a center portion therebetween, said lever being supported in the center portion in a drag bearing that is fixed to the machine, each said arm portion having a free end, swivel drive means for actuating said lever, said straightening die being fastened at the free end of one said arm portion to move in the arc of a circle during swiveling, said swivel drive means acting upon the free end of the other said arm portion in a direction transverse to said longitudinal direction, said bend-straightening machine comprising said swivel drive means being an electric motor for driving a drive spindle that is placed under said machine table.

2. The bend-straightening machine of claim 1, wherein said drag bearing includes an axis of rotation that is placed parallel to the longitudinal axis of said workpiece.

3. The bend-straightening machine of claim 1, wherein said drag beating is placed approximately at the height of said workpiece and one of said arm portions extends upwardly therefrom and essentially upright.

4. The bend-straightening machine of claim 3, wherein one said arm portion of said lever is bent from said workpiece and away from said other arm portion at an angle of from 10° to 40°.

5. The bend-straightening machine of claim 3, wherein one said arm portion of said lever is bent from said workpiece and away from said other arm portion at generally a right angle.

6. The bend-straightening machine of claim 1, wherein said machine table has ends that are opposite each other in the longitudinal direction of the workpiece, said lever at one end of said table, and a second lever at said opposite end of said table including second swivel drive means for actuating said second lever each of said drive means being synchronized and are linked with each other by means of a connecting link that extends parallel to the longitudinal direction of said workpiece, to form a constructional unit that can swivel.

7. The bend-straightening machine of claim 1, wherein said table includes two longitudinally opposite ends, said lever being placed at one end of said machine table, that at the opposite end of the table a second lever having only one arm portion is supported in an additional drag bearing that is aligned with the drag bearing of said lever, a one armed lever that extends parallel to one said arm portion of said lever and is of a generally equal length, and that said second lever and said one said arm portion are joined with each other by means of a connecting link that extends parallel to the longitudinal direction of said workpiece.

8. The bend-straightening machine of claim 6, wherein said straightening die is placed at said connecting link.

9. The bend-straightening machine of claim 8, wherein said straightening die is placed at said connecting link by means of a swiveling head that protrudes from said connecting link essentially horizontally above said workpiece.

10. The bend-straightening machine of claim 1, wherein said swivel drive means is a linear drive.

11. The bend-straightening machine of claim 10, wherein said straightening die is attached to a swiveling head, said swiveling head and said linear drive extend in the same direction.

12. The bend-straightening machine of claim 5, wherein said swivel drive means acts upon said lever by means of a transmission with varying velocity ratio.

13. The bend-straightening machine of claim 12, wherein said transmission with varying velocity ratio includes two connecting links that are supported in a rotating manner on a hinge block, said connecting links forming a small angle with each other, each said connecting link having ends opposite said hinge block, one said connecting link being connected with the free end of one said arm portion at a bearing, and said swivel drive means acting upon the hinge block to bring about a toggle effect.

14. The bend-straightening machine of claim 13, wherein said connecting links are supported at said hinge block by fork cheeks that overlap said hinge block.

15. The bend-straightening machine of claim 14, wherein said fork cheeks are supported at said hinge block on a common axle.

16. Bend-straightening machine for workpieces having longitudinally opposite ends that are more long than wide, said machine including workpiece seats and a machine table, said workpiece seats placed on and above said machine table to hold the ends of the workpiece so it can rotate, at least two straightening bases that are at a distance from each other along the longitudinal direction of the workpiece, said two straightening bases support the workpiece placed on the machine table, at least one straightening die that acts upon the workpiece between the straightening bases, and a lever having two arm portions and a center portion therebetween, said lever being supported in the center portion in a drag bearing that is fixed to the machine, each said arm portion having a free end, swivel drive means for actuating said lever, said straightening die being fastened at the free end of one said arm portion to move in the arc of a circle during swiveling, said swivel drive means acting upon the free end of the other said arm portion in a direction transverse to said longitudinal direction, said bend-straightening machine comprising said swivel drive means being an electric motor for driving a cam plate that is placed under said machine table.

17. The bend-straightening machine of claim 16, wherein said electric motor drives said cam plate in a rotating fashion around an axle that is fixed to said machine.

18. The bend-straightening machine of claim 17, wherein said axle of said cam plate is placed vertically underneath the free end of one of said arm portions of said lever.

19. The bend-straightening machine of claim 18, including a force transfer link having an upper and lower end, said upper end linked to said lever, said cam plate acting upon said lower end to provide vertical actuation of said transfer link.

20. The bend-straightening machine of claim 19, wherein said force transfer link is guided by a transverse link that is pivotably fixed to said force transfer link adjacent said lower end.

* * * * *